US005133816A

United States Patent [19]

Mills et al.

[11] Patent Number: 5,133,816

[45] Date of Patent: Jul. 28, 1992

[54] PRODUCTION OF ARTICLES FROM CURABLE COMPOSITIONS

[75] Inventors: David Mills; Alan D. Kington, both of Bristol, England

[73] Assignee: Rolls-Royce plc, London, England

[21] Appl. No.: 518,439

[22] Filed: May 3, 1990

[30] Foreign Application Priority Data

May 11, 1989 [GB] United Kingdom ..... 8910881

[51] Int. Cl.[5] ..... B32B 31/21; C04B 37/00

[52] U.S. Cl. ..... 156/89; 156/307.1; 156/331.1; 264/63

[58] Field of Search ..... 156/89, 307.1, 329, 156/331.1; 264/63

[56] References Cited

U.S. PATENT DOCUMENTS 4,767,479 8/1988 Ferguson et al. ..... 156/89

FOREIGN PATENT DOCUMENTS 472110 9/1937 United Kingdom .
882484 11/1961 United Kingdom .
927921 6/1963 United Kingdom .
931096 7/1963 United Kingdom .
1337137 11/1973 United Kingdom .
1387059 3/1975 United Kingdom .
1461878 1/1977 United Kingdom .

*Primary Examiner*—James Lowe
*Assistant Examiner*—Christopher A. Fiorilla

[57] ABSTRACT

Complex shapes, e.g. for ceramic cores, can be produced by bonding components with simpler shapes together without the use of glue or cement, thus permitting high precision and avoiding problems caused by excess of cement. The components are formed of curable binder (preferably thermosetting) and a filler (generally a ceramic powder). At least one of the components to be bonded is not completely cured. It is placed in close contact with another component. Heating to cure the uncured component(s) gives a bonded assembly which is then fired.

8 Claims, 1 Drawing Sheet

PRODUCTION OF ARTICLES FROM CURABLE COMPOSITIONS

The present invention relates to a method for the production of articles, from curable compositions generally comprising binders and fillers. Typical examples are ceramic articles, and particularly but not exclusively ceramic moulds and preformed cores for use in casting. The method involves the connection of two portions to provide a desired shape.

Ceramic and similar articles are conventionally produced from a deformable dough that is shaped by a machine process such as injection moulding, transfer moulding, pressing or extrusion. The dough is generally composed of a filler, generally composed of ceramic or other refractory powder and a liquid binder, usually with various additives to assist in the manufacturing process. Other fillers include metal powders and silicon powder (which may subsequently form silicon nitride).

The liquid binder must be hardenable to give a shaped piece. Desirably this can be handled, e.g. for subsequent firing. The liquid binder may be thermoplastic (e.g. based on a wax or a synthetic thermoplastic material) or thermoset (e.g. epoxy, polyester and silicone resins). We generally prefer thermoset resins, though the invention is applicable to both types. For producing quite complex shapes we generally use injection moulding with a thermoset binder. Since the basic ceramic powder is usually silica in the manufacture of preformed ceramic cores, we prefer to use a silicone resin. On firing, the residual silica from the resin aids bonding of the silica filler such that a relatively strong self-supporting ceramic is produced throughout the debonding and firing process.

However if a ceramic is required that will contain no silica then an alternative resin binder is used that will be completely removed at the firing stage.

In this case after the binder has been removed but before a sufficiently high temperature has been reached to sinter the ceramic, the piece is relatively weak and would require support. It is therefore again preferable to incorporate some compound that will form a suitable bonding agent at an early stage in the firing process and be retained in the final ceramic to achieve a self-supporting piece throughout the firing cycle.

With thermoplastic binders, in the early stages of the firing cycle they will usually resoften, so support to the moulded piece is essential to prevent sagging or distortion.

With thermoset binders, hardening is achieved after forming by a chemical process which is usually accelerated to a convenient rate by heat, usually a polymerization or cure reaction.

It should be noted, however, that if a thermoset binder is solid at room temperature, hardening can be achieved either by polymerization as described or like a thermoplastic, by allowing the moulding to cool below the solidification/congealing point of the binder.

In other words, mouldings can be produced with suitable thermoset based materials that are "cured" or "uncured" with the only difference in the method of manufacture being the temperature cycle used. It is also possible to convert an "uncured" moulding to a "cured" moulding by suitable heat treatment to allow the polymerization of the binder to proceed.

In a simple two piece injection moulding die, the complexity of moulded shape is limited. Since the die has to be opened without damaging the moulding, no undercut features are possible. There is a limit to undercut features that can be produced even with multipart tooling. One method of increasing complexity is by using inserts within the die that can be subsequently removed by dissolving, burning or vaporizing the insert out of the moulding. But one-piece moulding still has limitations, so it is known to produce more complex articles by bonding simpler shapes together with glue or cement. For example, US-A4,767,479 discloses a method of connecting two green cores containing a thermoplastic binder by applying ceramic particles to the mating surfaces, softening the binder (e.g. by apply a solvent) so that it flows into the particles, and then allowing it to harden.

However, there are disadvantages to any form of cement such as: the inherent fired bond weakness of suitable cements; the difficulty of maintaining location accuracy of the cemented parts; and, in some shapes, the physical difficulties in wiping or removing excessive adhesive from joints to maintain accuracy of form.

Broadly, the invention provides a method of producing an article from two components formed from curable composition(s) which are bonded together without the use of glue or cement or ceramic particles. We have found that if two mouldings, at least one of which is not fully cured, are in contact for a sufficient time at a suitable temperature, direct surface to surface bonding occurs. Furthermore, such bonded pieces, remain bonded when fully processed to the fired or ceramic state.

The method according to the invention preferably comprises: providing at least two components for forming respective portions of the articles, each component having been formed from a curable composition, at least one of the components not being fully cured; bringing mating surfaces of the components together in direct contact; and applying heat and/or pressure to effect bonding; and heating the bonded components to produce a fired article.

Generally, each component will have been produced from a dough comprising ceramic particles and a binder, the dough having been formed (e.g. by injection moulding). Preferably at least one component contains an uncured thermoset binder that is solid at the temperature at which the components are brought together. The other component may be in the same state or it may have been fully cured. The components may be bonded and then fired at a conventional temperature, e.g. at 1100° C.–1200° C. We have found that the best bond strengths are achievable if the whole firing cycle is carried out in a single operation. It is however, possible to carry it out in two stages, the article cooling somewhat after an initial heating stage in which binder residues are removed, and then being heated to the firing temperature.

It can be advantageous for one component to be fully cured, since it can support the uncured component during firing, which may be necessary if the uncured thermoset binder remelts before polymerization occurs. The remelting of the binder can actually be advantageous, as it allows the component to relax onto the other component, giving very good surface contact. Of course, with thermoplastic binders, softening will generally occur during firing. If an uncured component has overhang, support can be provided by spacers etc. which will subsequently be burnt out or volatilized away in the firing cycle, or by ceramic pieces that can be removed after firing. Spacers can also be used to ensure precise dimensional control in the fired assembly.

It is also possible, with suitable binders, to effect curing at below the softening temperature, e.g. by holding the temperature in a suitable range for a suitable time, or otherwise initiating polymerization. This can be used when none of the components is fully cured. Generally, the thermoset binders can be cured below 200° C., so that support chaplets can be used to control dimensions. They may be made of any low ash material that will burn off in the subsequent process, or of water soluble material.

The portions can differ in origin (e.g. an injection moulding can be bonded to a transfer moulding) and/or in composition, though excessive mismatch of thermal expansion properties etc must be avoided.

We have also found that wetting the surfaces of mating surfaces with a solvent of high boiling point, such as diethylene glycol, considerably enhances the ceramic bonding strength after firing. By suitable process arrangements, bond strengths equal to the bulk strength can be achieved. By using assemblies of cured, partially cured or uncured mouldings in the manner indicated, composite ceramics can also be produced. One material can be "sandwiched" between parts to be bonded.

Some embodiments of the invention will now be described by way of example with reference to the accompanying drawings in which.

COMPOSITION EXAMPLE 1

A mouldable dough was produced from the following:

Dow Corning Silicone Resin No: 62230 (6 kg)

Fused silica flour (−200 mesh B.S.S.) e.g. NALFLOC P1W grade (20 kg)

Stearic acid or aluminium stearate (300 g)

Aluminium acetate (150 g)

(The silicone resin is based on a phenylmethylsilane. It melts at about 60°-65° and contains about 60% of silica within its structure.)

The silica flour was put into a Z- or sigma-blade mixer or a two-roll mill and heated to 85°. The resin was added, melted, and was mixed in to form a hot dough to which the other components were added and mixed in. The dough was removed from the mixer, allowed to cool and solidify, and crushed and formed into pellets.

The pellets resoften if heated above 65°, and cure in 2-3 minutes at 150°. A moulding thus produced can be fired to form a silica ceramic component, without undergoing further softening. It retains considerable strength throughout the firing cycle. Even at 400°-500° in the cycle the residual silica from the silicone resin which has decomposed bonds the piece. It is usual to fire the core to a maximum temperature of around 1100° C.-1200° C. to develop some sintering of the silica core.

BONDING EXAMPLE 1

Using the composition from composition example 1, a first rectangular bar (100×40×12 mm) was moulded and cured using a die temperature of 150°, and removed from the die. A second like bar was moulded, but the die was held at 35° to give an "uncured" bar.

The uncured bar was placed on a flat refactory plate in a core firing oven. The cured bar was set on edge on the uncured bar, thus forming an inverted-T section.

The oven was switched on and the following firing cycle carried out.

| | |
|---|---|
| 20° C.-200° C. | in 7½ hours |
| 200° C.-350° C. | in 7½ hours |
| 350° C.-450° C. | in 14 hours |
| 450° C.-1100° C. | in 7½ hours |
| Hold at 1100° C. for 4 hours | |
| Cool naturally to 20° C. | |

The resulting fire ceramic test pieces were bonded together.

BONDING EXAMPLE 2

Figure 1:
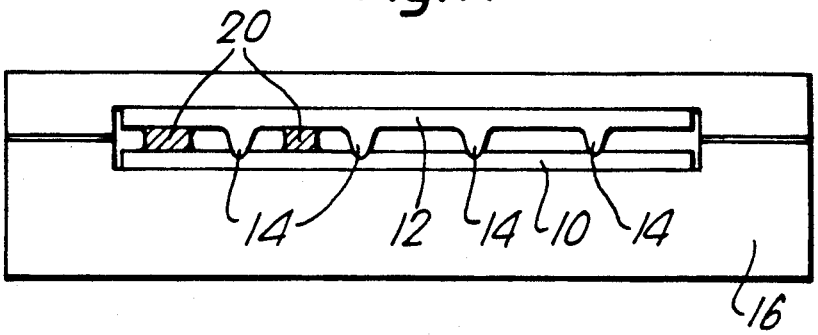
FIG. 1 is a section through a saggar assembly in which an article is being fired.

Two mouldings were produced generally as in the first example, but with the forms shown in FIG. 1. Thus the uncured bar 10 was a simple plate while the cured bar 12 had protruding pips 14. The bars 10, 12 were placed together in a two-part refractory support or "setter" 16, with the cured bar 12 on top and its pips 14 penetrating into the uncured bar 10 to an extent determined by carbon spacers 20, urged by the weight of the upper part of the saggar. After, firing, the two bars were found to be bonded together.

BONDING EXAMPLE 3

Figure 2:
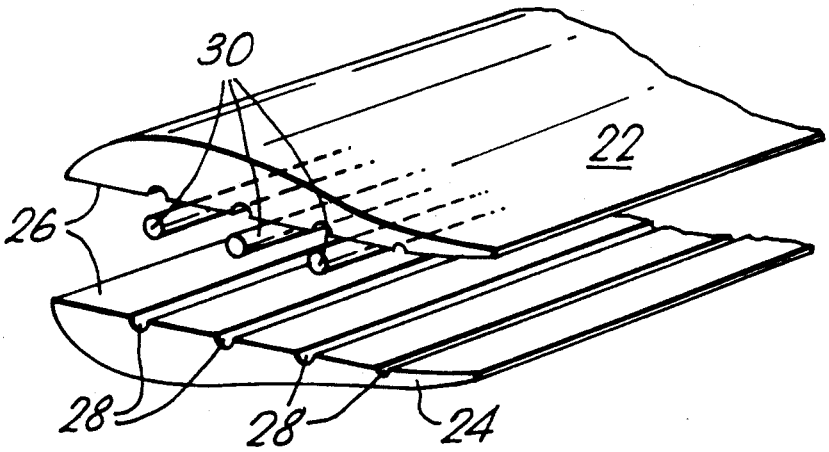
FIG. 2 is a perspective view of components used in a method embodying the invention.
Figure 3:
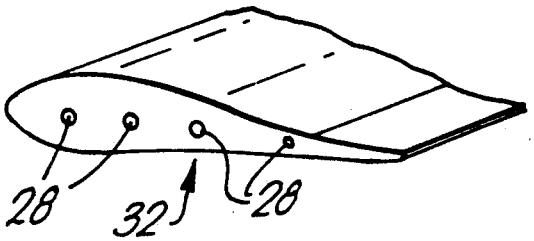
FIG. 3 is a perspective view of the product.

Two moudings were produced generally as in the first example, but with the forms shown in FIG. 2. Thus the two mouldings 22,24 are similar half-aerofoil sections each having a planar mating face 26 with longitudinal channels 28. These channels receive rods 30 of recrystallized alumina. The upper moulding 22 is uncured and the lower one 24 is cured. They were asembled about the rods 30 in a saggar, and fired to produce a composite stiffener 32 as shown in FIG. 3. There is no bonding between the mouldings 22, 24 and the rods, which can thus slide to allow for differential thermal expansion (alumina having a higher coefficient of expansion than silica).

BONDING EXAMPLE 4

Using a combination of "cured" and "uncured" test pieces as described in bonding Example 1, an assembly was built up by laying one upon another.

The assembly was heated to 85° C. and held for 24 hours. On cooling it was found that all pieces were bonded and "cured".

This assembly was fired as in Example 1 and found to be a bonded ceramic assembly.

BONDING EXAMPLE 5

A cured test piece as described in example 1 was broken approximately in half. One piece was dropped back into the hot die After a second injection cycle the piece was removed.

Subsequent firing produced a ceramic bar with no visible evidence of the bonded joint. A number of such composite bars and ordinary cured bars were tested to destruction using three point loading modules or rupture determination. No difference was found between the composite and ordinary bars.

COMPOSITION EXAMPLE 2

This is a formulation of low ceramic strength, suitable for avoiding excessive stresses on a solidifying casting, such as can occur with cores of high strength. The composition was produced by blending the following components, generally as in Composition Example 1:

| | |
|---|---|
| Wackers Silicone Intermediate SY430 | 3K |
| "BECKOPOX" Epoxy Resin E.P.301 (Hoechst) | 3K |
| Nalfloc P.1 W Silica Powder (−200 mesh B.S.S.) | 20K |
| Aluminium Stearate | 150 g |
| Carnauba Wax | 300 g |

BONDING EXAMPLE 6

The composition from composition example 2 was used to produce an uncured bar as in Bonding Example 1. This was sandwiched between two cured bars produced according to Bonding Example 1.

After the following firing cycle the weak pieces were bonded to the stronger outer bars.

| | |
|---|---|
| 20° C.-250° C. | in 10 hours |
| 250° C.-300° C. | in 20 hours |
| 300° C.-350° C. | in 25 hours |
| 350° C.-500° C. | in 20 hours |
| 500° C.-1100° C. | in 15 hours |
| Hold for four hours and cool. | |

This demonstrates a technique which is particularly useful for forming cores with very thick aerofoil shapes which need to be weak and crush at the casting solidification stage, but have thin delicate trailing edge features which need to be strong to avoid breakage with handling.

We claim:

1. A method of producing a ceramic article comprising:

(a) providing at least two pre-shaped components for forming respective portions of the article, each component having a surface adapted to mate with a corresponding surface of the other component, each component having been formed from a curable composition including silica powder and a binder comprising a curable thermosetting silicone resin;

(b) bringing said mating surfaces of the components together in direct contact such that a fully cured component is brought into contact with a component that is not fully cured;

(c) curing said non-fully cured component while said mating surfaces are in contact so as to effect bonding between the components; and (d) heating the bonded components to remove the binder and to produce a sintered coherent unitary ceramic structure.

2. A method of claimed in claim 1, wherein the silicone resin is based on a phenylmethylsilane and the curing is carried out at 150° C.

3. A method as claimed in claim 2, wherein the bonded components are heated from 200° C. to 1100° C. to remove the cured binder.

4. A method as claimed in claim 1, wherein the curing of said non-fully cured component is effected by the application of pressure.

5. A method as claimed in claim 1, wherein the binder in said non-fully cured component has been partially cured such that said non-fully cured component has handling strength but still undergoes bonding to another component due at least in part to said partially cured binder.

6. A method as claimed in claim 1, wherein the components which have been brought together are heated and at least one undergoes softening and rehardening; support being provided to restrain deformation in the softened state.

7. A method as claimed in claim 1, wherein the components which have been brought into contact are held at a temperature below the softening temperature of any component until all are cured.

8. A method as claimed in claim 1, comprising wetting at least one of the mating surfaces with a high-boiling point solvent for the binder before the mating surfaces are brought into contact.

* * * * *